United States Patent [19]

Chirumbolo

[11] 4,082,186

[45] Apr. 4, 1978

[54] PORTABLE CLEANING TOOLS

[75] Inventor: Frank Chirumbolo, New York, N.Y.

[73] Assignee: The Raymond Lee Organization, Inc., New York, N.Y. ; a part interest

[21] Appl. No.: 764,133

[22] Filed: Jan. 31, 1977

[51] Int. Cl.[2] ..... F41C 19/00

[52] U.S. Cl. ..... 206/577; 206/223; 15/145

[58] Field of Search ..... 206/577, 223, 373, 374, 206/376; 15/145, 245; 220/8

[56] References Cited

U.S. PATENT DOCUMENTS

| | | | |
|---|---|---|---|
| 2,639,454 | 5/1953 | Dory | 206/577 X |
| 4,002,236 | 1/1977 | Tolleson | 206/577 |

*Primary Examiner*—George T. Hall
*Attorney, Agent, or Firm*—Howard I. Podell

[57] ABSTRACT

A kit of portable cleaning tools storable in a bag. The kit includes a collapsable pail, a broom and wiper blade each separately attachable to the opposite ends of a pole, and a pole formed with male threads on one end section and one end section as a tapered cone on the opposed end section. The pole is formed of four segments joined by hinges and detachable latches. The axis of the hinge of the pole joining the two pole mid-sections is perpendicular to the axis of the two hinges each joining an outer pole section to a mid-section so that the pole folds to a compact structure.

4 Claims, 6 Drawing Figures

PORTABLE CLEANING TOOLS

SUMMARY OF THE INVENTION

My invention is a kit of portable cleaning tools storable in a bag. The kit includes a collapsable pail, a broom and wiper blade each separately attachable to the opposite ends of a pole, and a pole formed with male threads on one end section and one end section as a tapered cone on the opposed end section. The pole is formed of four segments joined by hinges and detachable latches. The axis of the hinge of the pole joining the two pole mid-sections is perpendicular to the axis of the two hinges each joining an outer pole section to a mid-section so that the pole folds to a compact structure.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
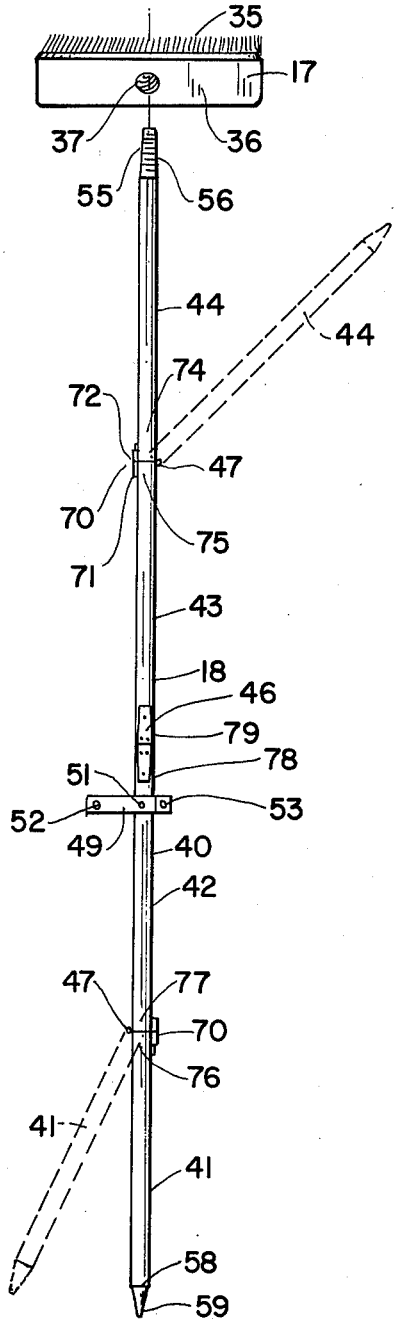
FIG. 1 is an exploded perspective view of the erect pole and broom.

Turning now descriptively to the drawings, in which similar reference characters denote similar elements throughout the several views, FIGS. 1–6 illustrate the kit 10 which consists of a flexible storage bag 11 in which a collapsed pail 15, a wiper blade 16, a broom 17 and a foldable pole 18 may be stored.

Figure 3:
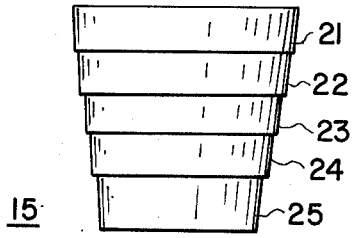
FIG. 3 is a side view of the pail in the extended mode.
Figure 4:
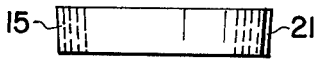
FIG. 4 is a side view of the pail in the collapsed mode.
Figure 5:
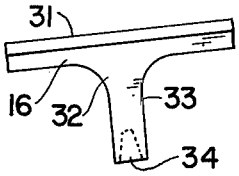
FIG. 5 is a plan view of the wiper blade.
Figure 6:
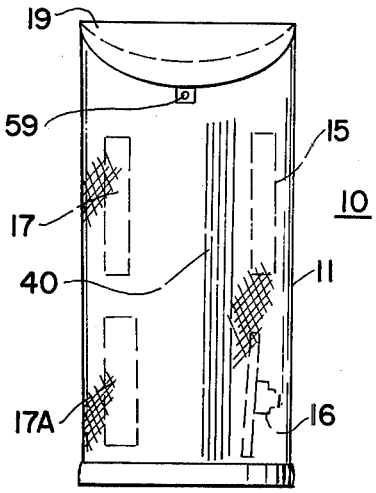
FIG. 6 is a front view of the storage bag.

Pail 15 is formed of concentric circular telescopic segments 21–25 of varied diameters such that bottom segment 25 nests within segment 24 which nests within segment 24 which nests within segment 23, which nests within segment 22 which in turn nests within top segment 21 in the stored position, as shown in FIG. 4, and which segments may be extended in telescopic fashion as shown in FIG. 3.

Wiper blade 16 is of conventional structure and consists of a flexible blade 31 fixed to a handle section 32, with a cylindrical socket section 33 of the handle section enclosing an open tapered hole 34.

Broom 17 is of a conventional structure and includes a plurality of bristles 35 fixed to a block 36 fitted with a tapered threaded hole 37.

Figure 2:
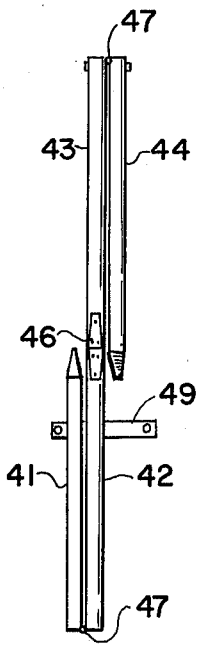
FIG. 2 is a side view of the pole, partially folded.

Pole 40 is formed of four solid cylindrical segments 41–44, with mid-segments 42–43 joined together by a hinge 46 and with each mid-segment 42, 43 joined by hinge 47 to an end segment 41, 44 respectively. The axes of hinges 47 are parallel to each other and perpendicular to the axis of hinge 46, so that in the folded condition, end segments 44 and 41 may be each folded against opposed sides of the extended structure of mid-segments 43 and 42 respectively, as shown in FIG. 2, with mid-segments 43 and 42 then folded to lie adjacent to each other, tangent to a longitudinal line that radially lies at ninety degrees, in section of segments 43, 42 to the line of tangency of segment 43 to segment 44 and segment 41 to segment 42 for compact storage. A strap 49 is fixed to mid-segment 42 by a rivet 51, with each end of strap 49 fitted with a mating snap fastener 52, 53 so that snap fasteners 52, 53 may be mutually engaged with strap 49 looped about the four folded pole segments.

A latch assembly 70 is mounted to the hinged end sections 74, 75 of pole segments 44, 43 respectively, to the hinged end sections 76, 77 of pole segments 41, 42 respectively and to the hinged end section 78, 79 of pole segments 42, 43 respectively to detachably latch the pole segments in the erect position shown in solid lines in FIG. 1. Each latch assembly 70 consists of a latch section 71 fixed to one end section of a segment of a shape to detachably latch to a latch section 72 fixed to the adjoining hinged end section of a pole segment.

End section 55 of pole end segment 44 is formed as a tapered male thread 56 of a size to engage threaded broom hole 37 and opposed end section 58 is formed with a tapered tip 59 of a size to engage wiper socket hole 34, so that the pole 40, when extended may be alternately attached at one end to a broom 17 or to a window brush 17A or at the other end to the wiper blade 16.

Bag 11 is preferably formed of flexible material and fitted with a cover section 19 that is fastened by a snap fastener 59 to the bag, in the closed position of the cover. The bag 11 is of a size to enclose the broom 17, a window brush 17A, the wiper balde 16, the pail 15 in the collapsed condition and the pole 40 in the folded condition.

Since obvious changes may be made in the specific embodiment of the invention described herein, such modifications being within the spirit and scope of the invention claimed, it is indicated that all matter contained herein is intended as illustrative and not as limited in scope.

Having thus described the invention, what I claim as new and desire to secure by Letters Patent of the United States is:

1. A portable kit of cleaning tools, comprising
a bag,
a collapsable pail of telescopic construction,
a wiper blade unit,
a broom unit, and
a foldable pole,
said bag of a size to enclose said wiper blade, broom unit, said pail in the collapsed condition, and said pole in the folded condition,
said pole shaped at one end with threaded means to engage a threaded hole in the broom unit, and shaped with a tapered section at the opposed end of the pole of a size to fit a tapered socket hole in the handle of the wiper blade.

2. The kit as recited in claim 1 in which the pole is formed of four segments, with two mid-segments joined together by first hinged means at a first end of each of said mid-segments and with each of the opposed second end of each mid-segment joined by second hinged means to an end of each end segment.

3. The combination as recited in claim 2 in which each os said hinged means permits the attached segments to rotate substantially one hundred and eighty degrees about the axis of the respective hinged means, with the axis of said first hinged means being perpendicular to the axes of each of the second hinged means.

4. The combination as recited in claim 1 in which each segment is fitted with detachable latching means to engage an adjacent hinged end segment in the erect position such that the latched segments extend along a common axis.

* * * * *